United States Patent [19]

Maglica et al.

[11] Patent Number: 4,819,141

[45] Date of Patent: Apr. 4, 1989

[54] FLASHLIGHT

[75] Inventors: Anthony Maglica, Ontario; Robert J. DeLong, Temple City; Armis L. Lewis, Cucamonga, all of Calif.

[73] Assignee: Mag Instrument, Inc., Ontario, Calif.

[21] Appl. No.: 43,086

[22] Filed: Apr. 27, 1987

Related U.S. Application Data

[63] Continuation-in-part of Ser. No. 34,918, Apr. 6, 1987, abandoned, which is a continuation of Ser. No. 828,729, Feb. 11, 1986, Pat. No. 4,658,336, which is a continuation of Ser. No. 648,032, Sep. 6, 1984, Pat. No. 4,577,263.

[51] Int. Cl.[4] ..... F21L 7/00

[52] U.S. Cl. ..... 362/207; 362/187; 362/197; 362/205

[58] Field of Search ..... 362/207, 202, 205, 208, 362/187, 188, 203, 197; 200/60

[56] References Cited

U.S. PATENT DOCUMENTS

| | | | |
|---|---|---|---|
| 1,559,481 | 10/1925 | Voorhees | 362/207 |
| 1,568,093 | 1/1926 | Shannon | 362/207 |
| 1,599,095 | 9/1926 | McCabe | 362/207 |
| 1,680,169 | 8/1928 | Osean | 362/207 |
| 1,680,188 | 8/1928 | Weber | 362/207 |
| 1,680,484 | 8/1928 | Stimson | 362/207 |
| 1,768,554 | 7/1930 | Freitag | 362/207 |
| 1,769,436 | 7/1930 | Koretzky . | |
| 1,905,787 | 4/1933 | Barber | 362/207 |
| 2,051,889 | 8/1936 | Nygard | 362/207 |
| 2,097,222 | 10/1937 | Tompkins | 362/207 |
| 2,210,312 | 8/1940 | Wood | 362/207 |
| 2,229,486 | 1/1941 | Barash | 362/207 |
| 2,298,042 | 10/1942 | Desimone | 362/207 |
| 2,341,057 | 2/1944 | Muldoon . | |
| 2,493,205 | 1/1950 | Muldoon | 362/207 |
| 2,530,913 | 11/1950 | Shackel | 362/207 |
| 4,151,583 | 4/1979 | Miller | 362/207 |
| 4,286,311 | 8/1981 | Maglica | 362/207 |
| 4,357,648 | 11/1982 | Nelson | 362/207 |
| 4,527,223 | 7/1985 | Maglica | 362/207 |
| 4,577,263 | 3/1986 | Maglica | 362/207 |

*Primary Examiner*—Willis R. Wolfe

*Attorney, Agent, or Firm*—Lyon & Lyon

[57] ABSTRACT

A flashlight having a conductive barrel and a tailcap insert which provides for a conductive path through the tail assembly region of the flashlight to the batteries contained in the barrel.

9 Claims, 5 Drawing Sheets

FLASHLIGHT

This application is a continuation in part of U.S. Ser. No. 034,918 filed Apr. 6, 1987 (abandoned) which is a continuation of U.S. Ser. No. 828,729 filed Feb. 11, 1986, which issued as U.S. Pat. No. 4,658,336 on Apr. 14, 1987, which is in turn a continuation of U.S. Ser. No. 648,032 filed on Sept. 6, 1984, which issued as U.S. Pat. No. 4,577,263 on Mar. 18, 1986.

BACKGROUND OF THE INVENTION

1. Field of the Invention

The present invention relates primarily to flashlights, and in particular, to a miniature hand-held flashlight and to a tailcap insert for use on flashlights of any size.

2. Discussion of the Prior Art

Flashlights of varying sizes and shapes are well-known in the art. In particular, certain of such known flashlights utilize two or more dry cell batteries, carried in series in a cylindrical tube serving as a handle for the flashlight, as their source of electrical energy. Typically, an electrical circuit is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlights, have been found to provide a more well-defined focus thereby enhancing the quality of the light beam produced. Additionally, several advances have been achieved in the light admitting characteristics of flashlight lamp bulbs.

Since there exists a wide variety of uses for hand-held flashlights, the development of the flashlight having a variable focus, which produces a beam of light having a variable dispersion, has been accomplished.

In some flashlights, the tailcap is a component of the electrical circuit and there must be electrical continuity from one part of the tailcap to another, usually from an outer peripheral region to an inner peripheral region. In such designs when the tailcap is anodized, painted or otherwise treated so that the surface of the tailcap loses all or a part of its ability to conduct current, then extra processing steps are required to remove the non-conductive coating.

SUMMARY OF THE INVENTION

It is a primary object of the present invention to provide a miniature hand-held flashlight having improved optical characteristics.

It is another object of the present invention to provide a miniature hand-held flashlight which is capable of producing a beam of light having a variable dispersion.

It is a further object of the present invention to provide a miniature hand-held flashlight which is capable of supporting itself vertically on a horizon surface to serve as an "ambient" unfocused light source.

It is another object of the present invention to provide a miniature hand-held flashlight wherein relative motions of components that produce the variation and the dispersion of the light beam provide an electrical switch function to open and complete the electrical circuit of the flashlight.

It is another object of the present invention to provide a tailcap insert for use in any size flashlight and for reduction or elimination of certain process steps otherwise required during manufacture of flashlights.

These and other objects of the present invention, which may become obvious to those skilled in the art through the hereinafter detailed description of the invention are achieved by a miniature flashlight comprising: a cylindrical tube containing at least two miniature dry cell batteries disposed in a series arrangement, a lamp bulb holder assembly including electrical conductors for making electrical contact between terminals of a miniature lamp held therein and the cylindrical tube and an electrode of the battery, respectively, retained in one end of the cylindrical tube adjacent the batteries, a tail cap and spring member enclosing the other end of the cylindrical tube and providing an electrical contact to the other electrode of the batteries, a head assembly including a reflector, a lens, and a face cap, which head assembly is rotatably mounted to the cylindrical tube such that the lamp bulb extends through a hole in the center of the reflector within the lens, and a tailcap insert which provides for better retention of a spare lamp bulb and provides for reduction in the number of process steps required for manufacture. In the principle embodiment of the present invention, the batteries are of the size commonly referred to as "pen light" batteries. However, the batteries may be of any size, specifically including the AAAA size, which have not been previously been known to be adapted for individual uses, such as in a miniature flashlight of the present invention.

The head assembly engages threads formed on the exterior of the cylindrical tube such that rotation of a head assembly about the axis of the cylindrical tube will change the relative displacement between the lens and the lamp bulb. When the head assembly is fully rotated onto the cylindrical tube, the reflector pushes against the forward end of the lamp holder assembly causing it to shift rearward within the cylindrical tube against the urging of the spring contact at the tailcap. In this position, the electrical conductor within the lamp holder assembly which completes the electrical circuit from the lamp bulb to the cylindrical tube is not in contact with the tube. Upon rotation of the head assembly in a direction causing the head assembly to move forward with respect to the cylindrical tube, pressure on the forward surface of the lamp holder assembly from the reflector is relaxed enabling the spring contact in the tailcap to urge the batteries and the lamp holder assembly in a forward direction, which brings the electrical conductor into contact with the cylindrical tube, thereby completing the electrical circuit and causing the lamp bulb to illuminate. At this point, the lamp holder assembly engages a stop which prevents further forward motion of the lamp holder assembly with respect to the cylindrical tube. Continued rotation of the head assembly in a direction causing the head assembly to move forward relative to the cylindrical tube causes the reflector to move forward relative to the lamp bulb, thereby changing the focus of the reflector with respect to the lamp bulb, which results in varying the dispersion of the light beam admitted through the lens.

By rotating the head assembly until it disengages from the cylindrical tube, the head assembly may be placed, lens down, on a substantially horizontal surface and the tailcap and cylindrical tube may be vertically inserted therein to provide a miniature "table lamp".

A generally cylindrical, conductive tailcap insert is placed inside of the tailcap. The insert has one portion which contacts the inner surface of the barrel and one portion which contacts the tail end spring member to provide for a conductive path from the barrel to the battery electrode. The tailcap insert of this design eliminates the need for removing any non-conductive layer on the outer surface of the tailcap and for removing any non-conductive layer on the inner surface of the tailcap. The insert also provides for improved storage capability for a spare lamp bulb. The tailcap insert of the present invention may be used on virtually any size flashlight and with many different designs in addition to the designs disclosed herein.

Although the principle embodiment of the present invention employs "AA" or pen light batteries, the present design may be scaled to accommodate other sizes of batteries such as "AAA", "N", "AAAA" and special battery sizes.

The "AAAA" battery has heretofore been known as a component in the conventional 9-volt battery having clip contacts on its upper end. The conventional 9-volt battery has within its outer casing six small batteries known as the "AAAA" battery. One of the embodiments of the present invention is a flashlight scaled to accommodate two "AAAA" batteries in series. It is believed that prior to its application in small flashlights of the present invention, the "AAAA" battery has not been adapted for individual use, but rather has been used only as a component of the conventional 9-volt battery. It is considered that the present invention includes the use of the "AAAA" battery for individual use, in flashlights, whether or not of the design as presently disclosed, as well as for use in other devices where a small, compact power supply is useful.

DETAILED DESCRIPTION OF A PREFERRED EMBODIMENT

Figures 1, 2, 3:
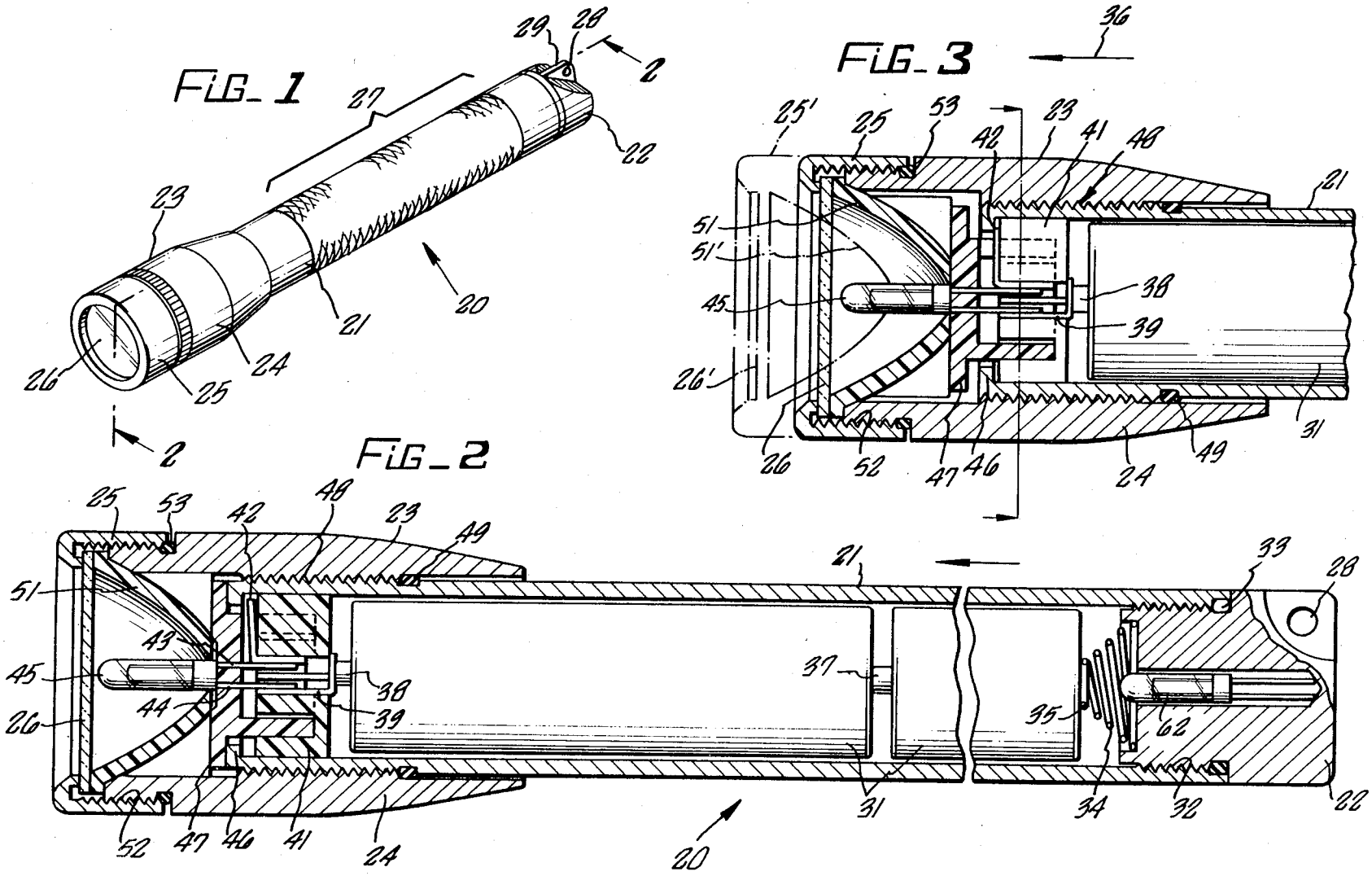
FIG. 1 is a perspective view of a miniature flashlight in accordance with the present invention.
FIG. 2 is a partially foreshortened cross-sectional view of the miniature flashlight of FIG. 1 as taken through the plane indicated by 2—2.
FIG. 3 is a partial cross-sectional view of a forward end of the miniature flashlight, illustrating, in ghost image, a translation of the forward end of the flashlight.

Referring first to FIG. 1, a miniature flashlight in accordance with the present invention is illustrated in perspective generally at 20. The miniature flashlight 20 is comprised of a generally right circular cylinder, or barrel 21, enclosed at a first end by a tailcap 22 and having a head assembly 23 enclosing a second end thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 may provide a machined handle surface 27 along its axial extent. The tailcap 22 may be configured to include provision for attaching a handling lanyard through a hole 28 in a tab 29 formed therein.

Referring next to FIG. 2, the barrel 21 is seen to have an extent sufficient to enclose at least two miniature dry cell batteries 31 disposed in a series arrangement. The tailcap 22 has a region of external threading 32 which engages matching threads formed on the interior surface of the barrel 21. A sealing element 33, typically in the form of an O-ring, is provided at the interface between the tailcap 22 and the barrel 21 to provide a watertight seal. A spring member 34 is disposed within the barrel 21 so as to make electrical contact with the tailcap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. The upper and lower insulators form an assembly which electrically and physically couples the bulb to the batteries when the head is in a predetermined position or is rotated off of the barrel. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45. Absent further assembly, the lower insulator receptacle is urged in the direction indicated by the arrow 36, by the action of the spring 34, to move until it comes into contact with a lip 46 formed on the end of the barrel 21. At that point electrical contact is made between the side contact conductor 42 and the lip 46 of the barrel 21.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a water-tight seal between the head assembly 23 and the barrel 21 and O-ring 73 is installed adjacent to lens 26 inside of face cap 25. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. An 0-ring 53 may be incorporated at the interface between the face cap 25 and the head 24 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36. The upper insulator receptacle 47 then pushes the lower insulator receptacle 41 in the same direction, thereby providing a space between the forwardmost surface of the lower insulator receptacle 41 and the lip 46 on the forward end of the barrel 21. The side contact conductor 42 is thus separated from contact with the lip 46 on the barrel 21 as is shown in FIG. 2.

Referring next to FIG. 3, appropriate rotation of the head 24 about the axis of the barrel 21 causes the head assembly 23 to move in the direction indicated by the arrow 36 through the engagement of the threads 48. Upon reaching the relative positions indicated in FIG. 3 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 (FIG. 2) translating the batteries 31 in the direction of the arrow 36, to the illustrated position. In this position, the side contact conductor 42 has been brought into contact with the lip 46 on the forward end of the barrel 21, which closes the electrical circuit.

Further rotation of the head assembly 23 so as to cause further translation of the head assembly 23 in the direction indicated by the arrow 36 will result in the head assembly 23 reaching a position indicated by the ghost image of FIG. 3, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to a focus of the parabola of the reflector 51, thereby varying the dispersion of the light beam emanating from the lamp bulb 45 through the lens 26.

Figures 4, 5, 6, 7, 8:
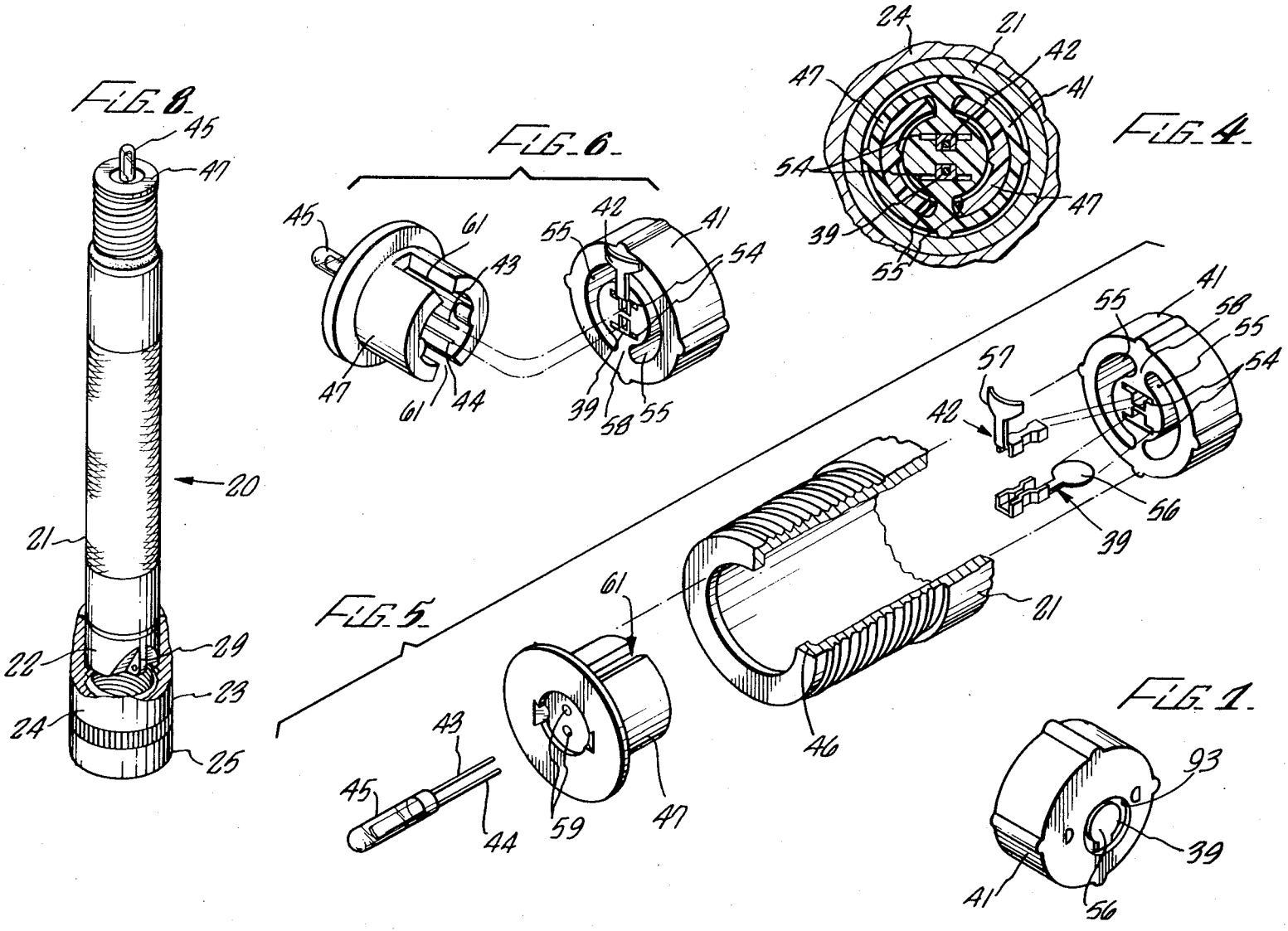
FIG. 4 is a partial cross-sectional view of a lamp bulb holder assembly used in accordance with the present invention, taken along the plane indicated by 4—4 of FIG. 3.
FIG. 5 is an exploded perspective view illustrating the assembly of the lamp bulb holder assembly with respect to a barrel of the miniature flashlight.
FIG. 6 is an isolated partial perspective view illustrating the electro mechanical interface between electrical terminals of the lamp bulb and electrical conductors within the lamp bulb holder.
FIG. 7 presents a perspective view of a rearward surface of the lamp bulb holder of FIG. 5 illustrating a battery electrode contact terminal.
FIG. 8 illustrates an alternate utilization of the miniature flashlight in accordance with the present invention.

Referring next to FIG. 4, a partial cross-sectional view illustrates the interface between the lower insulator receptacle 41 and the upper insulator receptacle 47. The lower insulator receptacle 41 has a pair of parallel slots 54 formed therethrough which are enlarged in their center portion to receive the center conductor 39 and the side contact conductor 42, respectively. A pair of arcuate recesses 55 are formed in the lower insulator receptacle 41 and receive matching arcuate extensions of the upper insulator receptacle 47. The lower insulator receptacle 41 is movably contained within the inner diameter of the barrel 21 which is in turn, at the location of the illustrated cross-section, enclosed within the head 24.

Referring next to FIGS. 5 through 7, a preferred procedure for the assembly of the lower insulator receptacle 41, the center conductor 39, the side contact conductor 42, the upper insulator receptacle 47 and the miniature lamp bulb 45 may be described. Placing the lower insulator receptacle 41 in a position such that the arcuate recesses 55 are directionally oriented towards the forward end of the barrel 21 and the lip 46, the center conductor 39 is inserted through one of the slots 54 such that a substantially circular end section 56 extends outwardly from the rear surface of the lower insulator receptacle 41. The circular end section 56 is then bent, as shown in FIG. 7, to be parallel with the rearmost surface of the lower insulator receptacle 41 in a position centered to match the center electrode of the forwardmost one of the batteries 31 of FIG. 2. The side contact conductor 42 is then inserted into the other slot 54 such that a radial projection 57 extends outwardly from the axial center of the lower insulator receptacle 41. It is to be noted that the radial projection 57 aligns with a web 58 between the two arcuate recesses 55.

The lower insulator receptacle 41, with its assembled conductors, is then inserted in the rearward end of the barrel 21 and is slidably translated to a forward position immediately adjacent the lip 46. The lamp electrodes 43 and 44 are then passed through a pair of holes 59 formed through the forward surface of the upper insulator receptacle 47 so that they project outwardly from the rear surface thereof as illustrated in FIG. 6. The upper insulator receptacle 47, containing the lamp bulb 45, is then translated such that the lamp electrodes 43 and 44 align with receiving portions of the side contact conductor 42 and the center conductor 39, respectively. A pair of notches 61, formed in the upper insulator receptacle 47, are thus aligned with the webs 58 of the lower insulator receptacle 41. The upper insulator receptacle 47 is then inserted into the arcuate recesses 55 in the lower insulator receptacle 41 through the forward end of the barrel 21.

Referring again to FIGS. 2 and 3, the electrical circuit of the miniature flashlight in accordance with the present invention will now be described.

Electrical energy is conducted from the rearmost battery 31 through its center contact 37 which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly 23 has been rotated about the threads 48 to the position illustrated in FIG. 2, the side contact conductor 42 does not contact the lip 46 of the barrel 21, thereby resulting in an open electrical circuit. However, when the head assembly 23 has been rotated about the threads 48 to the position illustrated by the solid lines of FIG. 3, the side contact conductor 42 is pressed against the lip 46 by the lower insulator receptacle 41 being urged in the direction of the arrow 36 by the spring 34 of FIG. 2. In this configuration, electrical energy may then flow from the side contact conductor 42 into the lip 46, through the barrel 21 and into the tailcap 22 of FIG. 2. The spring 34 electrically couples the tailcap 22 to the case electrode 35 of the rearmost battery 31. By rotating the head assembly 23 about the threads 48 such that the head assembly 23 moves in a direction counter to that indicated by the arrow 36, the head assembly 23 may be restored to the position illustrated in FIG. 2, thereby opening the electrical circuit and turning off the flashlight.

Referring next to FIG. 8, an additional utilization of the miniature flashlight 20 in accordance with the present invention is illustrated. By rotating the head assembly 23 about the threads 48 in a direction causing the head assembly 23 to translate relative to the barrel 21 in the direction of the arrow 36 of FIG. 3, the electrical circuit will be closed as previously described, and the lamp bulb 45 will be illuminated. Continued rotation of the head assembly 23 in that direction enables the head assembly 23 to be completely removed from the forward end of the miniature flashlight 20. By placing the head assembly 23 upon a substantially horizontal surface (not illustrated) such that the face cap 25 rests on the surface, the tailcap 22 of the miniature flashlight 20 may be inserted into the head 24 to hold the barrel 21 in a substantially vertical alignment. Since the reflector 51 (FIG. 2) is located within the head assembly 23, the lamp bulb 45 will omit a substantially spherical illumination, thereby providing a "ambient" light level.

In a preferred embodiment, the barrel 21, the tailcap 22, the head 24, and the face cap 25, forming all of the exterior metal surfaces of the miniature flashlight 20 are manufactured from aircraft quality, heat-treated aluminum, which is annodized for corrosion resistance. The sealing O-rings 33, 49, and 53 provide atmospheric sealing of the interior of the miniature flashlight 20 to a depth of 200 feet. All interior electrical contact surfaces are appropriately machined to provide efficient electrical conduction. The reflector 51 is a computer generated parabola which is vacuum aluminum metallized to ensure high precision optics. The threads 48 between the head 24 and the barrel 31 are machined such that revolution of the head assembly 23 through less than ¼ turn will close the electrical circuit, turning the flashlight on, and an additional ¼ turn will adjust the light beam from a "spot" to a "soft flood". A spare lamp bulb 62 may be provided in a cavity machined in the tailcap 22.

As referred to in the above description of a preferred embodiment, the tailcap 22 is annodized for corrosion resistance. Such annodizing also necessarily provides a barrier to the conductive path from the barrel 21 to the spring 34. In such situations, and other situations where a non-conductive coating is placed on the tailcap, additional, subsequent process steps are required to machine or otherwise remove at least a portion of the coating from a region on the outer periphery of the tailcap where it mates with the inner perhiphery of the barrel 21 and from a region on the inner periphery of the tailcap where it comes in contact with the spring 34. By reference to FIGS. 9–15, a tailcap insert which eliminates the need for these subsequent process steps and which provides for other advantages will be described.

Figure 9:
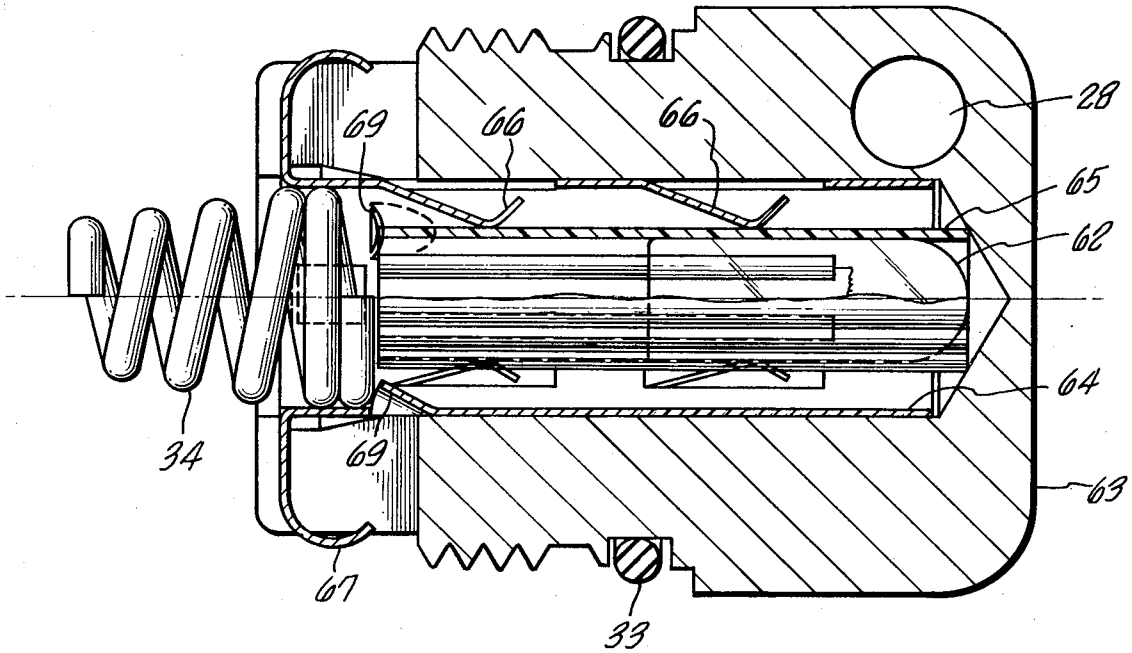
FIG. 9 is a partial cross-sectional view of an alternate tailcap having an insert in accordance with the present invention.

Referring to FIG. 9, a partial cross-sectional view of an alternate tailcap 63 is shown holding the tailcap insert 64 of the present invention. Insert 64 is sized to hold spare bulb 62 which preferably is placed inside of an optional small plastic protective holder, shown in part at 65. Spare bulb 62 and/or the holder 65 are secured with aid of indents 66 which are cut into the sides of the insert 64. Wings 67 extend radially outward from the central annular portion of insert 64 and provide for contact with the inner surface of barrel 21 upon insertion of the tailcap 63 into the barrel 21. An O-ring is also shown at 33.

Figure 10:
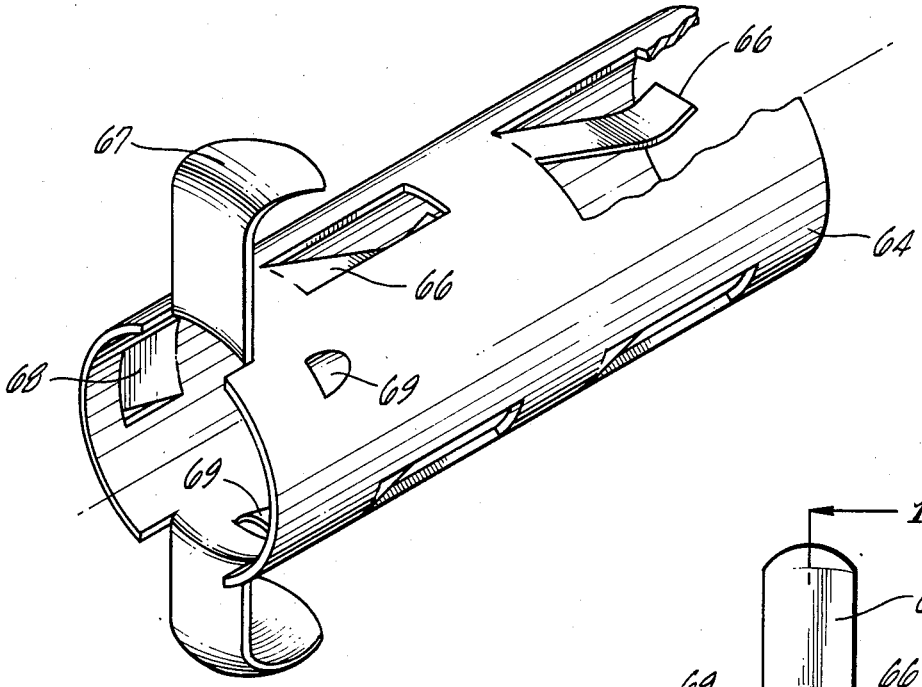
FIG. 10 is a perspective view of the insert of FIG. 9.

Referring to FIG. 10, a perspective view of the insert of the present invention is shown. Snap lock 68 provides for securing insert 64 within tailcap 63. Two of three backstops 69 for preventing spring 34 from slipping back into insert 64 are also shown.

Figure 11:
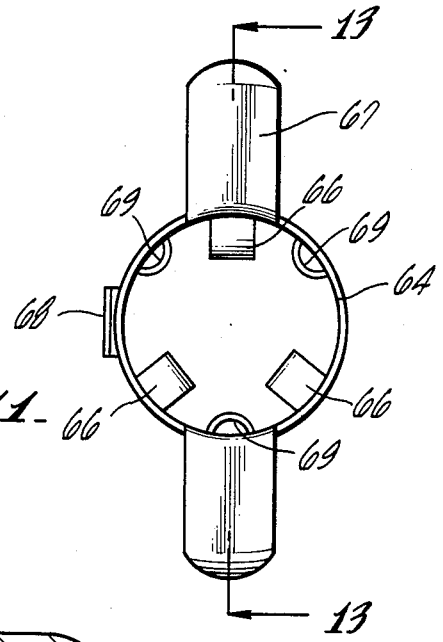
FIG. 11 is a front view of the insert shown in FIG. 10.

Referring to FIG. 11, a front view of insert 64 is shown wherein the orientation of indents 66, snap lock 68 and backstops 69 are more clearly shown.

Figure 13:
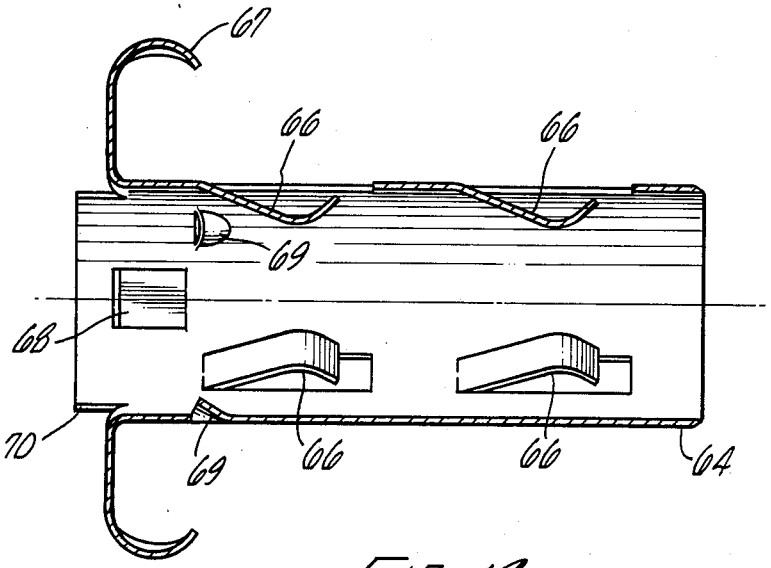
FIG. 13 is a cross-sectional view of the insert of FIG. 11 taken along line 13—13.

Referring to FIG. 13 a cross-sectional view of insert 64 taken along line 13—13 of FIG. 11 is shown to highlight the degree of indentation of indents 66, backstops 69 and to show the orientation of wings 67 with respect to the edge 70 of insert 64.

Figure 14:
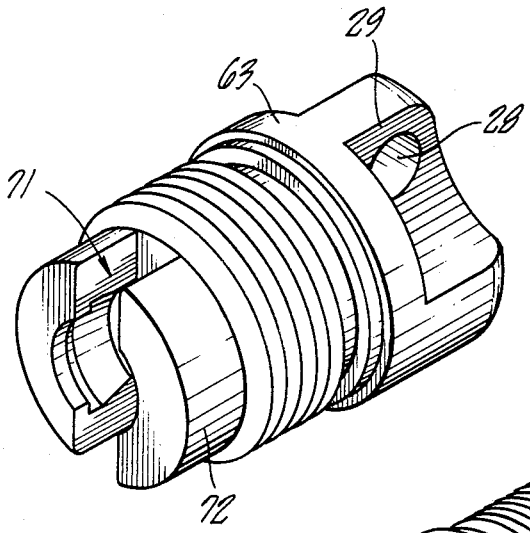
FIG. 14 is a front perspective view of the tailcap of FIG. 9.

Referring to FIG. 14 a front perspective view of alternate tailcap 63 is shown. Slot 71 is cut into the front, unthreaded portion 72 of alternate tailcap 63 to provide for orientation and protection of the wings 67 of the insert 64.

Figure 15:
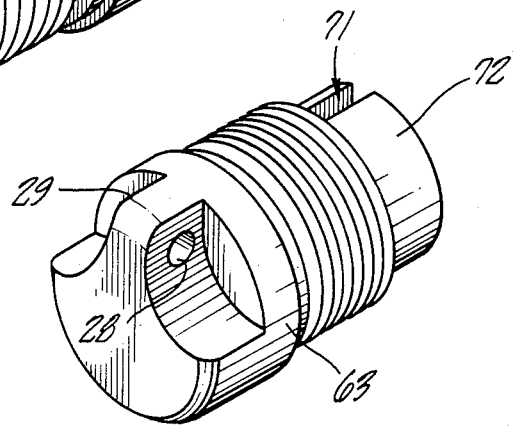
FIG. 15 is a rear perspective view of the tailcap of FIG. 9.

FIG. 15 is a rear prespective view of the alternate tailcap 63, having slot 71, portion 72 and the rearwardly extending portion having a different, curved or scalloped appearance than that shown in FIG. 1. The alternate tailcap also has provision for a hole 28 and a tab 29 for attaching a lanyard.

Figure 12:
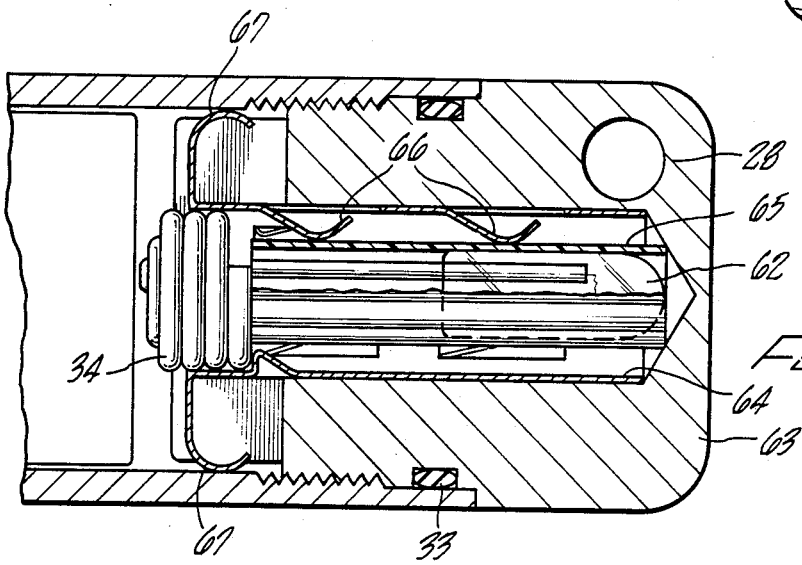
FIG. 12 is a cross-sectional view of the insert of FIG. 9 and shown in a flashlight assembly.

As may be seen from the above description and as shown in FIG. 12, insert 64 provides for a conductive path from the inside of barrel 21, through wings 67 of the insert, the insert body itself and then to spring 34 which is in contact with insert 64 at least at backstops 69. As may readily be appreciated, a conductive path is thus formed even though the entire tailcap may be made of insulator material or coated with an insulator material. In conventional designs where the tailcap is coated with an insulator material, additional machining steps is required to remove this material at regions 73 and 74, as shown in FIG. 2. The tailcap insert of the present invention may be made of any suitable conductive material, such as beryllium copper.

While I have described a preferred embodiment of the herein invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A flashlight comprising:

a barrel made of an electrically conductive material and for retaining a battery source of power;

a tailcap having a non-conductive layer on its surface and threadably engaging one end of the barrel;

a spring electrically coupled to the battery source of power a head assembly including a reflector and a lens adapted to engage the outer end of the barrel;

a bulb;

means for electrically coupling the bulb to the battery source of power;

means for switching the flashlight on and off; and an insert made of an electrically conductive material positioned within and along a major portion of the length of the tailcap wherein the insert provides for a conductive path between the barrel and the spring; and wherein the spring is positioned partially within the insert.

2. The flashlight of claim 1 wherein the insert is a cylindrical member having means for retaining a spare bulb, means for securing the insert into the tailcap assembly and means for preventing the spring from retracting into the insert beyond a pre-determined location.

3. An insert for use in a flashlight of the type having a barrel, a battery source of power, a tailcap and a spring which forms an electrical contact with one end of the battery source of power, said insert comprising:

a conductive generally cylindrically shaped member sized for insertion into and along at least one-half the length of the tailcap of the flashlight and disposed to provide electrical coupling between the barrel and the spring; and a plurality of indents in the member and positioned to retain a spare bulb for the flashlight, wherein the inert provides for a conductive path between the barrel in a tailcap region of the flashlight and the spring.

4. The insert of claim 3 further comprising:

means for securing the insert within the tailcap.

5. The insert of claim 4 further comprising:

means for preventing a tailcap spring from retracting within the insert beyond a pre-determined distance.

6. The insert of claim 3 wherein the insert includes means for electrically coupling the barrel to the insert, said means extending radially outwardly from the insert.

7. A flashlight comprising:

a barrel made of an electrically conductive material and for retaining a battery source of power;

a tailcap having a non-conductive layer on its surface and threadably engaging one end of the barrel, a spring disposed within the barrel and being adapted to engage the battery source of power, a head assembly including a reflector and a lens, the assembly being adapted to engage the other end of the barrel;

a bulb;

means for electrically coupling the bulb to the battery source of power;

means for switching the flashlight on and off; and an cylindrical insert made of an electrically conductive material positioned within and extending along at least one half the length of the tailcap and extending therefrom and engaging the spring to provide a conductive path between the barrel and the spring.

8. An insert for a flashlight having a barrel, a lamp bulb, a battery source of power, a spring electrically coupled to the battery source of power and a tailcap said insert comprising:

a conductive metal insert positioned within the barrel, electrically coupling the barrel to the spring and having a body portion of tubular shape and of a size capable of containing a spare lamp bulb and a pair of arm members extending radially outwardly from the body portion and contacting the barrel to provide a conductive path between the barrel and the spring.

9. The flashlight of claim 8 wherein the arm members further include near their distal ends portions which curve back in towards the body portion of the insert and bear against the barrel.

* * * * *

UNITED STATES PATENT AND TRADEMARK OFFICE

CERTIFICATE OF CORRECTION

PATENT NO. : 4,819,141

DATED : April 4, 1989

INVENTOR(S) : Anthony Maglica, Robert J. DeLong and Armis L. Lewis

It is certified that error appears in the above-identified patent and that said Letters Patent is hereby corrected as shown below:

In column 9, line 49, the word "inert" should be replaced with the word "insert".

Signed and Sealed this

First Day of October, 1991

*Attest:*

HARRY F. MANBECK, JR.

*Attesting Officer*

*Commissioner of Patents and Trademarks*